United States Patent [19]

Conley

[11] 4,166,557

[45] Sep. 4, 1979

[54] BELT ATTACHED HANGER

[76] Inventor: Timothy E. Conley, Rte. 2, Echo, Oreg. 97826

[21] Appl. No.: 833,006

[22] Filed: Sep. 14, 1977

Related U.S. Application Data

[63] Continuation of Ser. No. 649,829, Jan. 16, 1976, abandoned, which is a continuation of Ser. No. 237,673, Mar. 24, 1972, abandoned.

[51] Int. Cl.[2] ..... A45C 1/04

[52] U.S. Cl. ..... 224/101; 2/300; 224/253

[58] Field of Search ..... 224/26 R, 5 A, 2 F, 224/5 B, 26 B, 26 K, 26 F, 5 R, 26 G, 26 D; 24/3 D, 73 C; 2/300

[56] References Cited

U.S. PATENT DOCUMENTS

| | | | |
|---|---|---|---|
| 1,413,290 | 4/1922 | O'Leary | 224/2 F |
| 1,525,344 | 2/1925 | Viegelmann | 224/26 R |
| 2,543,313 | 2/1951 | Dietzgen | 224/26 R |
| 2,559,981 | 7/1951 | McBride | 224/5 R |
| 2,983,412 | 5/1961 | Ferguson | 224/26 R |
| 3,516,584 | 6/1970 | Fabyan | 224/5 A |

*Primary Examiner*—Robert J. Spar
*Assistant Examiner*—Kenneth W. Noland
*Attorney, Agent, or Firm*—Klarquist, Sparkman

[57] ABSTRACT

A belt attached hanger for supporting key chains, measuring tapes and other devices from the pants support belt of the user. The hanger includes a flexible closed loop having a vertical opening in the back thereof intermediate the opposite side edges thereof. The loop encompasses the belt with one of the belt loops of the trousers extending through the opening in the back and engaged over the belt to lock the loop at a specific point on the belt with respect to the trousers. A wire support is engaged in the bottom of the loop below the belt and has an eye for attaching the devices to be supported by the loop.

1 Claim, 5 Drawing Figures

FIG. 1.
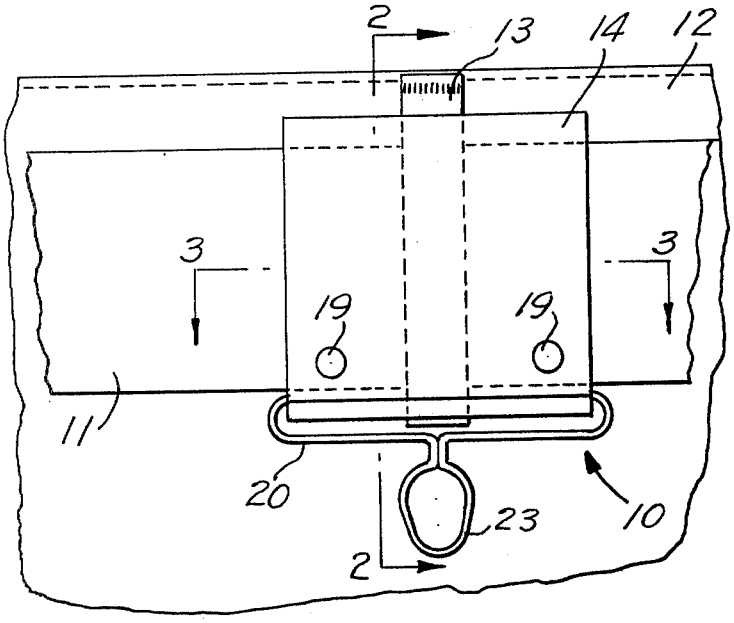
FIG. 2.
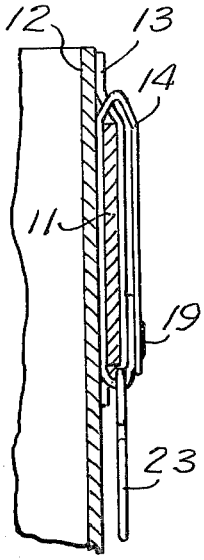
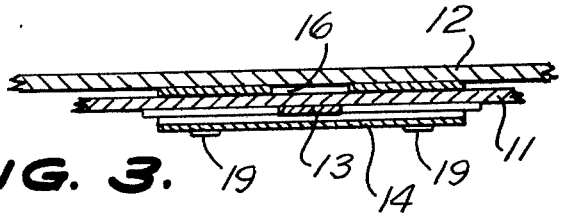
FIG. 3.
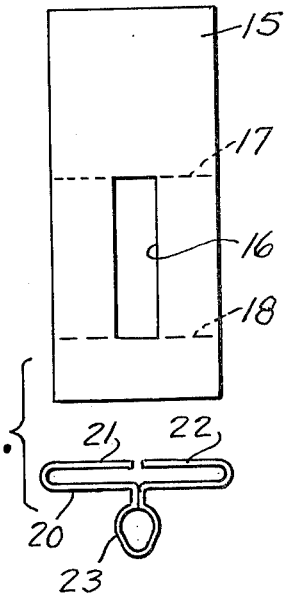
FIG. 4.
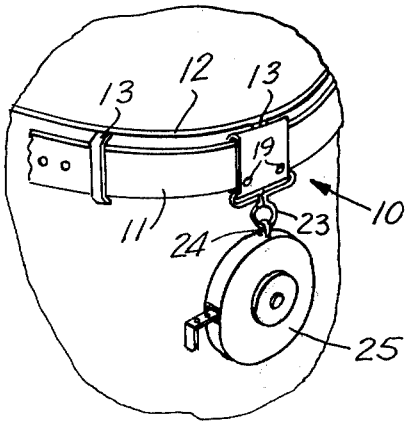
FIG. 5.

BELT ATTACHED HANGER

This is a continuation of application Ser. No. 649,829, filed Jan. 16, 1976 now abandoned, which in turn is a continuation of application Ser. No. 237,673, filed Mar. 24, 1972, abandoned.

BACKGROUND OF THE INVENTION

1. Field of the Invention

The present invention relates to support hangers for attachment to the belt of the user.

2. Summary of the Invention

The support hanger of the present invention includes a flexible loop which is engaged over the belt of the user and has a vertical opening on the back thereof to permit the belt loop to extend into the flexible loop and engage over the belt to thus lock the support loop in a single position on the belt. A wire support including an eye is attached to the support loop for supporting devices to be carried by the hanger.

The primary object of the invention is to provide a hanger attachment for trouser belts which are locked to one belt loop of the trousers.

Other objects and advantages will become apparent in the following specification when considered in the light of the attached drawings.

BRIEF DESCRIPTION OF THE DRAWINGS

FIG. 1 is a front elevation of the invention shown attached to a trousers belt and a belt loop on the trousers;

FIG. 2 is a vertical cross section taken along the line 2—2 of FIG. 1 looking in the direction of the arrow;

FIG. 3 is a horizontal sectional view taken along the line 3—3 of FIG. 1 looking in the direction of the arrow;

FIG. 4 is an elevational view of the loop and support shown prior to folding and assembling;

FIG. 5 is a perspective view of the invention with a tape reel secured thereto.

Referring now to the drawings in detail wherein like reference characters indicate like parts throughout the several figures the reference numeral 10 indicates generally a hanger attachment for a trousers belt constructed in accordance with the invention.

The hanger attachment 10 is adapted for use with a belt 11 supporting a pair of trousers 12 by extending through a plurality of belt loops 13. The belt 11, trousers 12 and belt loops 13 are all of conventional design.

The hanger 10 includes a loop 14 formed from a generally rectangular blank 15 having a generally rectangular opening 16 formed therein.

The blank 15 is folded along dotted line 17 at the top of the opening 16 and along dotted line 18 to form a closed loop. Rivets 19 connect the opposite ends of the loop 14 together although it should be understood that these ends may be secured together by any desired means such as stitching, adhesive or the like.

A wire support 20 is formed with its opposite ends 21,22 arranged in axially aligned abutting relation so as to be engaged in the lower end of the loop 14. An eye 23 is formed integrally in the center of the support 20 and depends therefrom to support a loop 24 in a flexible tape 25 as illustrated in FIG. 5. It should be understood that the eye 23 may also support other devices such as key rings when desired.

In the use and operation of the invention the loop 14 is positioned over a desired belt loop 13 with belt loop 13 extending through the opening 16 in the back of the loop 14. The belt 11 is then threaded through the belt loop 13 to support the trousers 12. The loop 14 is locked to the loop 13 and the belt 11 and cannot slide around the trousers 12.

Having thus described the preferred embodiment of the invention, it should be understood that numerous structural modifications and adaptations may be resorted to without departing from the spirit of the invention.

What is claimed is:

1. The hanger support attachment for trouser belts comprising a belt for supporting a pair of trousers and belt loops to receive said belt and a hanger loop of flexible material having overlapping end portions permanently secured together, the hanger loop having a back side and a front side, an upright opening formed in only the back side of said hanger loop for permitting a belt loop to extend therethrough and engage about said belt so that the hanger loop is supported by said belt, and means supported by said hanger loop for securing devices to said hanger loop to be suspended below said hanger loop, said hanger loop being adapted to fit closely around said belt and entirely around the belt and completely covering said belt loop, said upright opening being generally rectangular in form and extending parallel to the opposite sides of said hanger loop, the upright opening extending from just below the top of the belt loop to just above the bottom of the belt loop.

* * * * *